US011898232B2

(12) United States Patent
Mann et al.

(10) Patent No.: US 11,898,232 B2
(45) Date of Patent: Feb. 13, 2024

(54) HIGH-STRENGTH ALLOY BASED ON ALUMINIUM AND METHOD FOR PRODUCING ARTICLES THEREFROM

(71) Applicant: United Company RUSAL Engineering and Technology Centre LLC, g. Krasnoyarsk (RU)

(72) Inventors: Viktor Khrist'yanovich Mann, g. Krasnoyarsk (RU); Aleksandr Nikolaevich Alabin, g. Krasnoyarsk (RU); Anton Valer'evich Frolov, g. Krasnoyarsk (RU); Aleksandr Olegovich Gusev, g. Krasnoyarsk (RU); Aleksandr Yur'evich Krokhin, g. Krasnoyarsk (RU); Nikolaj Aleksandrovich Belov, g. Krasnoyarsk (RU)

(73) Assignee: United Company RUSAL Engineering and Technology Centre LLC, g. Krasnoyarsk (RU)

( * ) Notice: Subject to any disclaimer, the term of this patent is extended or adjusted under 35 U.S.C. 154(b) by 481 days.

(21) Appl. No.: 15/764,186

(22) PCT Filed: Apr. 29, 2016

(86) PCT No.: PCT/RU2016/000262
§ 371 (c)(1),
(2) Date: Mar. 28, 2018

(87) PCT Pub. No.: WO2017/058052
PCT Pub. Date: Apr. 6, 2017

(65) Prior Publication Data

US 2018/0274073 A1 Sep. 27, 2018

(30) Foreign Application Priority Data

Sep. 29, 2015 (RU) ..... 2015141320

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC . C22C 21/00; C22C 21/10; C22F 1/04; C22F 1/053
See application file for complete search history.

(56) References Cited

U.S. PATENT DOCUMENTS 6,585,932 B1 * 7/2003 Axenov ..... C22C 21/10 148/549
2004/0101434 A1 * 5/2004 Fridlyander ..... C22C 21/10 420/532

(Continued)

FOREIGN PATENT DOCUMENTS

RU 2158780 C1 * 11/2000
RU 2215808 C2 * 11/2003

(Continued)

OTHER PUBLICATIONS

Akopyan et al., "Calculation-Experimental Study of the Phase Composition of Al—Zn—Mg—(Cu)—Ni—Fe Aluminum Alloys", 2013. Metally, vol. 2013, No. 7, pp. 545-552 (Year: 2013).*

(Continued)

*Primary Examiner* — John A Hevey
(74) *Attorney, Agent, or Firm* — HOGAN LOVELLS US LLP

(57) ABSTRACT

The present invention relates to metallurgy of high-strength cast and wrought alloys based on aluminum, and can be used in missioncritical designs operable under load, in the transport field, sports industry, casings for electronic devices, and other industrial sectors. The technical result aims to enhance mechanical characteristics of articles produced from the (Continued)

alloy by precipitation hardening caused by secondary phases in the age-hardening process while providing high workability during casting. The claimed high-strength alloy comprises zinc, magnesium, nickel, iron, copper, zirconium, and at least one metal selected from a group consisting of titanium, scandium and chromium, with the following amounts in, wt %: zinc 3.8-7.4; magnesium 1.2-2.6; nickel 0.5-2.5; iron 0.3-1.0; copper 0.001-0.25; zirconium 0.05-0.2; titanium 0.01-0.05; scandium 0.05-0.10; chromium 0.04-0.15; and the remainder being aluminum, wherein iron and nickel form aluminides of the $Al_9FeNi$ phase, which originates from eutectic transformation and represents at least 2 vol %.

8 Claims, 2 Drawing Sheets

(56) References Cited

U.S. PATENT DOCUMENTS

2004/0115087 A1* 6/2004 Axenov ..... C22C 21/10 148/417
2007/0017604 A1* 1/2007 Yan ..... C22C 21/10 148/549
2007/0039668 A1* 2/2007 Axenov ..... C22C 21/10 148/439
2007/0243097 A1* 10/2007 Sarrazin ..... C22C 21/12 420/532
2010/0068090 A1* 3/2010 Langan ..... C22C 21/10 420/530
2015/0050520 A1* 2/2015 Niikura ..... C22F 1/043 428/654
2016/0258042 A1* 9/2016 Sanaty-Zadeh ..... C21D 9/0068

FOREIGN PATENT DOCUMENTS

RU 2245388 C1 * 1/2005
RU 2419663 C2 * 5/2011
RU 2484168 C1 * 6/2013

OTHER PUBLICATIONS

Belov et al., "Influence of Nickel Aluminide and Magnesium Silicide on the Structure and Mechanical and Casting Properties of Al—Zn—Mg—Cu Alloy", 1992. Metally, No. 1, pp. 146-151 (Year: 1992).*

* cited by examiner

HIGH-STRENGTH ALLOY BASED ON ALUMINIUM AND METHOD FOR PRODUCING ARTICLES THEREFROM

This application is a U.S. National Phase under 35 U.S.C. § 371 of International Application PCT/RU2016/000262, filed on Apr. 29, 2016, which claims priority to Russian application 2015141320, filed on Sep. 29, 2015. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

FIELD OF THE INVENTION

The present invention relates to the field of metallurgy of high-strength cast and wrought alloys based on aluminum, and can be used for producing articles used in mission-critical designs operable under load. The claimed invention can be used in the field of transport, including in production of automotive components, including cast wheel rims, parts for railway transport, parts of aircrafts, such as airplanes, helicopters and components for missilery, in the sports industry and sports equipment, for example for manufacture of bicycles, scooters, exercise equipment, for manufacture of casings of electronic devices, as well as in other branches of engineering and industrial management.

PRIOR ART

Silumins (based on the Al—Si system) are the most popular casting alloys. As main doping elements to improve the strength of alloys of this system, copper and magnesium (typical for alloys of A354 and A356 series) are used. These alloys usually exhibit a strength level below about 300 and 380 MPa (for alloys of A356 and A354 series, respectively) which is the absolute maximum for these materials when used in conventional methods for obtaining shaped castings.

The commercial aluminum casting alloys of AM5 series (σ=400-450 MPa) belong to the Al—Cu—Mn system (Alieva S. G., Altman M. B., Ambartsumyan S. M. et al. Promyshlennye alyuminievye splavy (Industrial aluminum alloys). /Reference book./Moscow, Metallurgiya, 1984.528 p.). The main drawbacks of such alloys include a relatively low casting performance due to the poor casting characteristics provoking many problems for production of shaped castings and for permanent mold casting in the first place.

Among high-strength wrought alloys, the particular attention deserves alloys of the Al—Zn—Mg—Cu system which have high mechanical properties, in particular, σ=600 MPa can be achieved for wrought semifinished articles under the heat treatment condition No. T6 (Aluminum. Properties and Physical Metallurgy, Ed. J. Hatch, 1984). The main method for production of wrought semifinished articles, for example, pressed articles from 7xxx alloys, comprises implementing following steps: preparing a melt, casting of ingots, homogenizing of ingots, deformation processing and strengthening heat treatment (for example, under the heat treatment condition No. T6, where the conditions need to be selected based on the alloy composition and the requirements for desired mechanical properties). The major drawbacks of high-strength wrought alloys and a method for producing wrought semifinished articles therefrom include poor casting characteristics of flat and cylindrical ingots due to the increased tendency to develop casting fractures, poor argon-arc welding characteristics and high demands for primary aluminum purity in terms of iron and silicon content in the first place, since they are detrimental impurities in such alloys.

It is known a high-strength alloy of the Al—Zn—Mg—Cu—Sc system for castings used for airspace and automotive industry disclosed in the Patent Alcoa Int. EP 1885898 B1 (published on Feb. 13, 2008, issue 2008 July). The alloy comprising 4-9% Zn; 1-4% Mg; 1-2.5% Cu; <0.1% Si; <0.12% Fe; <0.5% Mn; 0.01-0.05% B; <0.15% Ti; 0.05-0.2% Zr; 0.1-0.5% Sc can be used for production of castings with strength properties (by 100% higher than in the A356 alloy) using following casting methods: the low-pressure casting, the gravity die casting, piezocrystallization casting and others. Among the drawbacks of the present invention, particular attention should be paid to the lack of eutectics forming elements in a chemical composition (when an alloy structure is substantially an aluminum solution), thus, inhibiting relatively complex shaped castings to be produced. In addition, the chemical composition of the alloy comprises a limited amount of iron which requires relatively pure primary aluminum grades to be used as well as the presence of a combination of small additives of transition metals including scandium which is sometimes unreasonable (for example, for sand casting due to the low cooling speed).

Another known high-strength alloy of the Al—Zn—Mg—Cu system and a method for production of pressed, stamped and rolled semifinished articles is disclosed in the publication US 20050058568 A1 Pechiney (published on 17 Mar. 2005). The suggested aluminum alloy has the following chemical composition: 6.7-7.5% Zn, 2.0-2.8% Cu, 1.6-2.2% Mg and additionally, at least one element from a group of 0.08-0.2% Zr, 0.05-0.25% Cr, 0.01-0.5% Sc, 0.05-0.2 Hf и 0.02-0.2 V, and Si+Fe<0.2%. Wrought semifinished articles manufactured using this material provide a combination of high mechanical properties and fracture resistance. This alloy has disadvantages which include, above all, a high tendency to high-temperature cracking in cast ingots caused by the extended crystallization interval making it impossible to use argon-arc welding and a low restriction limit for iron and silicon content.

Among high-strength alloys, it is worth mentioning an aluminum-based material comprising 5-8% Zn-1.5-3% Mg-0.5-2% Cu—Ni which is described in the publication US 20070039668 A1 (published on 22 Feb. 2007). The key feature of this material distinguishing it from typical alloys of 7xxx series is the alloy structure peculiar in a nickel phase generated in an aluminide structure in the amount of 3.5-11 vol. %. The material can be used to produce wrought semifinished articles (by pressing, rolling) and to produce shaped castings. The drawbacks of the material include: 1) the need to use superpurity aluminum, 2) the presence of a copper additive which reduces alloy solidus, thus, limiting the ability to obtain specified sizes of nickel intermetallic phases at the stage of heat treatment.

The closest to the suggested invention is a high-strength aluminum-based alloy disclosed in the Patent of National University of Science and Technology MISiS RU 2484168C1 (published on 10 Jun. 2013, issue 16). This alloy comprises the following range of concentrations of doping components (wt. %): 5.5-6.5% Zn, 1.7-2.3% Mg, 0.4-0.7% Ni, 0.3-0.7% Fe, 0.02-0.25% Zr, 0.05-0.3% Cu and Al-base. This alloy can be used to produce shaped castings characterized by the ultimate resistance of no less than 450 MPa, and to produce wrought semifinished articles in the form of a rolled sheet material characterized by the ultimate resistance of no less than 500 MPa. The drawbacks of this invention are in that the aluminum solution is left unmodified which in some cases is necessary to reduce the risk of cast hot-cracking (of castings and ingots), in addition, the maximum amount of the iron in the alloy is no more than 0.7% allowing to use an iron-reach raw material. Castings, ingots and wrought semifinished articles made of this alloy cannot be continuously heated above 450° C. because of possible coarsening of secondary precipitates of zirconium phase of $Al_3Zr$.

DISCLOSURE OF THE INVENTION

The present invention provides a new high-strength aluminum alloy containing up to 1% of Fe characterized by the high mechanical properties and the high performance for obtaining shaped castings and ingots (in particular, high casting properties).

The technical effect obtained by the present invention is in enhancing strength properties of articles made of the alloy resulted from secondary precipitates of a strengthening phase via dispersion hardening with the provision of high performance for production of ingots and casting.

In accordance with one aspect of the invention, said technical effect can be obtained by the high-strength aluminum-based alloy comprising zinc, magnesium, nickel, iron, copper, and zirconium, and additionally, comprising at least one metal selected from the group including titanium, scandium, and chromium with the following ratios, wt. %:

| | |
|---|---|
| Zinc | 3.8-7.4 |
| Magnesium | 1.2-2.6 |
| Nickel | 0.5-2.5 |
| Iron | 0.3-1.0 |
| Copper | 0.001-0.25 |
| Zirconium | 0.05-0.2 |
| Titanium | 0.01-0.05 |
| Scandium | 0.05-0.10 |
| Chromium | 0.04-0.15 |
| Aluminum | the rest, |

wherein iron and nickel create preferably aluminides of the $Al_9FeNi$ eutectic phase the volume fraction of which is no less than 2 vol. %.

In accordance with some preferred embodiments of the present invention, the following requirements must be met, either separately, or in combination:

- the total amount of zirconium and titanium is no more than 0.25 wt. %,
- the total amount of zirconium, titanium, and scandium is no more than 0.25 wt. %,
- the total amount of zirconium and scandium is no more than 0.25 wt.,
- the total amount of zirconium, titanium, and chromium is no more than 0.20 wt. %,
- the ratio Ni/Fe≥1 exists,
- iron and nickel create eutectic aluminides having the particle size no more than 2 μm,
- a high-strength alloy can comprise aluminum produced electrolytically using an inert anode,
- zirconium and titanium are substantially in the form of secondary phases having the particle size of no more than 20 nm and the $L1_2$ crystal lattice,
- the condition Zn/Mg>2.7 is met.

In accordance with one preferred embodiment of the present invention, the technical effect can be obtained by the high-strength aluminum-based alloy comprising zinc, magnesium, nickel, iron, copper, and zirconium, and additionally, comprising at least one metal selected from the group including titanium and chromium with the following ratios, wt. %:

| | |
|---|---|
| Zinc | 5.7-7.2 |
| Magnesium | 1.9-2.4 |
| Nickel | 0.6-1.5 |
| Iron | 0.3-0.8 |
| Copper | 0.15-0.25 |
| Zirconium | 0.11-0.14 |
| Titanium | 0.01-0.05 |
| Chromium | 0.04-0.15 |
| Aluminum | the rest, |

wherein iron and nickel create preferably aluminides of the $Al_9FeNi$ eutectic phase the volume fraction of which is no less than 2 vol. %, and the total amount of zirconium and titanium is no more that 0.25 wt. %.

In accordance with another preferred embodiment of the present invention, the technical effect can be obtained by the high-strength aluminum-based alloy comprising zinc, magnesium, nickel, iron, copper, and zirconium, and additionally, comprising at least one metal selected from the group including titanium and scandium with the following ratios, wt. %:

| | |
|---|---|
| Zinc | 5.5-6.2 |
| Magnesium | 1.8-2.4 |
| Iron | 0.3-0.6 |
| Copper | 0.01-0.25 |
| Nickel | 0.6-1.5 |
| Zirconium | 0.11-0.15 |
| Titanium | 0.02-0.05 |
| Scandium | 0.05-0.10 |
| Aluminum | the rest, |

wherein iron and nickel create preferably aluminides of the $Al_9FeNi$ eutectic phase the volume fraction of which is no less than 2 vol. %.

In accordance with a preferred embodiment of the present invention, the total amount of zirconium, titanium, and scandium is no more than 0.25 wt. %.

In accordance with another aspect of the present invention, said alloy can be in the form of castings or another semifinished product or article. In accordance with one preferred embodiment, an article made of the alloy can be a wrought article. This wrought article can be produced in the form of rolled products (sheets or plates), punched and pressed profiles. In accordance with a preferred embodiment, an article can be made in the form of castings.

In accordance with another aspect, the present invention provides a method for production of wrought articles made of a high-strength alloy, comprising the following steps: preparing a melt, producing ingots by melt crystallization, homogenizing annealing of the ingots, producing wrought articles by working the homogenized ingots, heating the wrought articles, holding the wrought articles for hardening at the predetermined temperature and water hardening of the wrought articles, aging the wrought articles, wherein the homogenizing annealing is conducted at the temperature of no more than 560° C., the wrought articles are held for hardening at the temperature in the range of 380-450° C., and the wrought articles are aged at the temperature of no more than 170° C.

In accordance with some preferred embodiments, wrought articles can be aged as follows:

at least in two steps: at a first step at the temperature of 90-130° C., and at a second step at the temperature up to 170° C.;

by holding at a room temperature for at least 72 hours.

In accordance with another aspect, the present invention provides a method for production of castings from a high-strength alloy, comprising the following steps: preparing a melt, producing a casting, heating the casting, holding the casting for hardening at the predetermined temperature, water hardening the casting and aging the casting, wherein the casting is held for hardening at the temperature 380-560° C., and the casting is aged at the temperature of no more than 170° C.

In accordance with some preferred embodiments, castings can be aged as follows:

at least in two steps: at a first step at the temperature of 90-130° C., and at a second step at the temperature up to 170° C.;

by holding at a room temperature for at least 72 hours.

EMBODIMENTS OF THE INVENTION

Figure 1A:
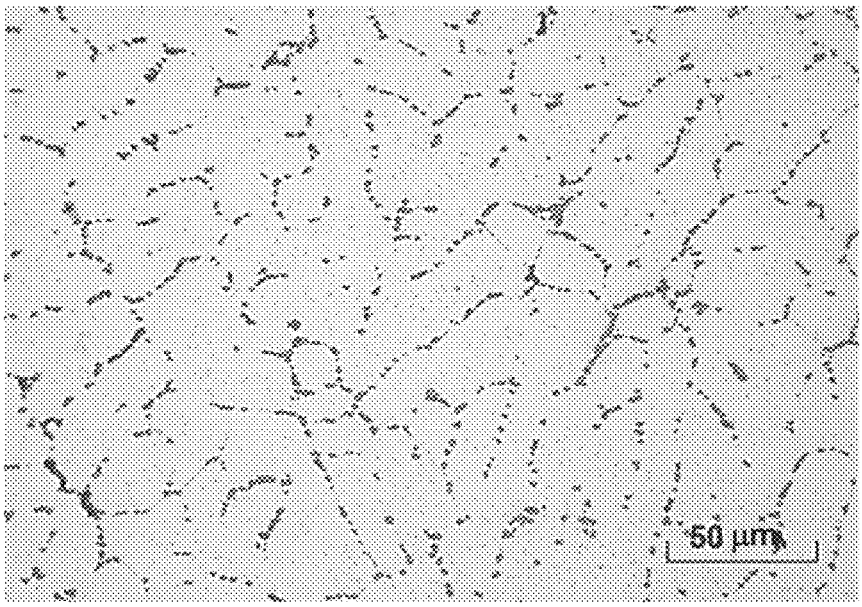
FIG. 1*a* shows a structure of homogenized ingots which is typical for metal mold casting by the following casting techniques: the low-pressure casting, the gravity casting, piezocrystallization casting.

The claimed range of doping elements enables the achievement of the high mechanical properties and performance of casting and working treatment. For this the structure a high-strength aluminum alloy must be as follows: an aluminum solution strengthened with secondary precipitates of phases of strengtheners and a eutectic component having the volume fraction of no less than 2% and an average cross dimension of no more than 2 μm. Said amount of the eutectic component ensures the desired performance for obtaining ingots and castings.

The claimed amounts of doping components which provide for achieving a predetermined structure within the alloy are supported by the following.

The claimed amounts of zinc, magnesium, and copper are required to create secondary precipitates of the strengthening phase via dispersion hardening. At lower concentrations, the amount will be insufficient to achieve the desired level of strength properties, and at higher amounts, the relative elongation can be reduced below the required level, as well as the casting and working performance.

The claimed amounts of iron and nickel are required to generate in the structure a eutectic component which is responsible for high casting performance. At higher iron and nickel concentrations, it is likely for corresponding primary crystallization phases to be generated in the structure seriously deteriorating mechanical properties. At a lower content of eutectics forming elements (iron and nickel), there is a high risk of hot cracking in the casting.

The claimed amounts of zirconium, scandium, and chromium are required to generate secondary phases of $Al_3Zr$ and/or $Al_3(Zr,Sc)$ with the $L1_2$ lattice and $Al_7Cr$ the average size of which is no more than 10-20 nm and 20-50 nm, respectively. At lower concentrations, the number of particles will be no longer sufficient for increasing the strength properties of castings and wrought semifinished articles, and at higher amounts, there is a risk of forming primary crystals adversely affecting the mechanical properties of castings and wrought semifinished articles.

The claimed amounts of titanium are required to modify a hard aluminum solution. In addition, titanium can be used to generate secondary phases with the $L1_2$ lattice (at the combined introduction of zirconium and scandium) which are beneficial for strength properties. If the titanium content is lower than the recommended one, there is a risk of hot cracking in casting. The higher content gives rise to the risk of creation of primary crystals of Ti-comprising phase in the structure which deteriorate the mechanical properties.

The inventive limit of the total amount of zirconium, titanium, and scandium which is no more than 0.25 wt. % is based on the risk of developing primary crystals comprising said elements which can deteriorate the mechanical characteristics.

EXAMPLES OF THE EMBODIMENTS

Example 1

To defend the concentration range in which doping elements can create the required structure and consequently provide the required mechanical properties, in a laboratory setting 13 alloys in the form of cylindrical ingots with the diameter 40 mm (chemical compositions are shown in Table 1) were produced. The alloys were produced in a resistance furnace in graphite crucibles from pure metals and masters (wt. %), in particular from aluminum (99.95), including aluminum obtained using an inert anode technology (99.7), zinc (99.9), magnesium (99.9) and masters Al-20Ni, Al—STi, Al-10Cr, Al-2Sc and Al-10Zr.

TABLE 1

Compositions of experimental alloys

| | Concentration in the alloy, wt. % | | | | | | | | | |
|---|---|---|---|---|---|---|---|---|---|---|
| No | Zn | Mg | Ni | Fe | Cu | Zr | Sc | Ti | Cr | Al |
| 1 | 3.5 | 1.0 | 0.3 | 0.2 | <0.001 | 0.01 | 0.01 | 0.01 | <0.001 | The rest |
| 2 | 3.8 | 1.2 | 2.5 | 0.3 | 0.01 | 0.15 | 0.1 | <0.001 | 0.10 | The rest |

TABLE 1-continued

| Compositions of experimental alloys | | | | | | | | | | |
|---|---|---|---|---|---|---|---|---|---|---|
| | Concentration in the alloy, wt. % | | | | | | | | | |
| No | Zn | Mg | Ni | Fe | Cu | Zr | Sc | Ti | Cr | Al |
| 3 | 5.2 | 2.0 | 0.5 | 0.4 | 0.25 | 0.2 | <0.001 | 0.02 | <0.001 | The rest |
| 4 | 5.9 | 1.8 | 0.8 | 0.6 | 0.01 | 0.12 | 0.05 | 0.05 | <0.001 | The rest |
| 5 | 6.1 | 2.1 | 1.5 | 0.8 | 0.15 | 0.11 | 0.05 | 0.03 | 0.1 | The rest |
| 6 | 6.2 | 2.0 | 0.9 | 0.8 | 0.01 | 0.14 | <0.001 | 0.02 | 0.04 | The rest |
| 7 | 6.3 | 2.1 | 0.6 | 0.3 | 0.25 | 0.14 | 0.1 | <0.001 | <0.001 | The rest |
| 8 | 6.3 | 2.1 | 0.55 | 0.45 | 0.001 | 0.11 | <0.001 | 0.015 | <0.001 | The rest |
| 9 | 6.5 | 2.4 | 1.0 | 1.0 | 0.05 | 0.11 | <0.001 | <0.001 | 0.12 | The rest |
| 10 | 7.4 | 2.6 | 0.7 | 0.3 | 0.001 | 0.14 | <0.001 | <0.001 | 0.15 | The rest |
| 11 | 7.5 | 2.8 | 2.3 | 1.1 | 0.4 | 0.08 | <0.001 | 0.08 | 0.15 | The rest |
| 12 | 6.3 | 2.0 | 0.8 | 1.0 | 0.001 | 0.11 | <0.001 | 0.015 | 0.11 | The rest |
| 13 | 6.4 | 1.9 | 0.5 | 0.4 | 0.001 | 0.20 | 0.10 | 0.05 | 0.15 | The rest |

The degree of strengthening of experimental alloys based on how hardness (HB) changed after thermal treatment with respect to the maximum strength under the heat treatment condition No T6 (water hardening and aging) was assessed by hardness values according to the Brinell scale. Structural parameters, in particular, the presence of primary crystals were assessed metallographically. Results of hardness HB changes and structure analysis, as well as the amounts, are shown in Table 2.

As can be seen from Table 2, the required structure parameters and the effect of dispersion hardening are provided only by the claimed alloy (compositions 2-10), except compositions 1 and 11-13. For instance, the alloy having the composition 1 has a low tendency to strengthening, and its hardness value is 81 HB. The structure of the alloy No. 11 contained coarse acicular particles of the $Al_3Fe$ phase having the cross dimension more than 3 μm, and the estimated amount of these primary crystals was 0.18 vol. %. The structure of the alloy No. 12 contained unacceptable acicular particles of $Al_3Fe$ which were of the eutectic nature. The structure of the alloy No. 13, the total amount of Zr, Sc, and Ti of which was 0.35%, contained primary crystals of these transition metals. The presence of particles of both types is unacceptable, and in some articles they will deteriorate mechanical characteristics, furthermore, these elements will provide no beneficial effect.

TABLE 2

| Hardness and structure parameters of experimental alloys | | | | |
|---|---|---|---|---|
| | | | $Q_v$, vol. % | |
| No[1] | HB | Phases containing Fe and Ni | Fe-eut | Fe-(other) |
| 1 | 81 | $Al_9FeNi$-eut | 1.15 | — |
| 2 | 102 | $Al_9FeNi$-eut | 6.05 | — |
| 3 | 153 | $Al_9FeNi$-eut | 2.16 | — |
| 4 | 147 | $Al_9FeNi$-eut | 3.43 | — |
| 5 | 162 | $Al_9FeNi$-eut | 5.70 | — |
| 6 | 158 | $Al_9FeNi$-eut | 4.19 | — |
| 7 | 162 | $Al_9FeNi$-eut | 2.16 | — |

TABLE 2-continued

| Hardness and structure parameters of experimental alloys | | | | |
|---|---|---|---|---|
| | | | $Q_v$, vol. % | |
| No[1] | HB | Phases containing Fe and Ni | Fe-eut | Fe-(other) |
| 8 | 155 | $Al_9FeNi$-eut | 2.42 | — |
| 9 | 168 | $Al_9FeNi$-eut | 4.96 | — |
| 10 | 188 | $Al_9FeNi$-eut | 2.42 | — |
| 11 | 185 | $Al_9FeNi$-eut, $Al_3Fe$-prim. | 8.00 | 0.18 |
| 12 | 159 | $Al_9FeNi$-eut, $Al_3Fe$-eut. | 4.13 | 0.25 |
| 13 | 162 | $Al_9FeNi$-eut, (Al, Zr, Sc, Ti)-prim. | 2.16 | — |

[1]Alloy compositions (see Table 1)

In the structure of alloys 2-10, iron and nickel (at the ratio Ni/Fe≥1) create advantageously aluminides of the eutectic phase $Al_9FeNi$ (comprised in the eutectics Al+$Al_9FeNi$) having beneficial morphology and the average cross dimension no more than 2 μm and volume fraction more than 2 vol. %.

Example 2

The inventive alloy with the composition 8 (Table 1) was used in a laboratory setting to produce cylindrical ingots having a diameter of 125 mm and length of 1 m. Next, the ingots were homogenized at the temperature of 540° C. The structure of homogenized ingots is shown in FIG. 1. The homogenized ingots were worked into a strip with a cross-section of 6×55 mm (FIG. 2) on the commercial facility LLC "KraMZ" at the initial temperature of ingots 400° C. Wrought semifinished articles were water hardened from the temperature of 450° C. Pressed semifinished articles were aged at a room temperature (natural aging)—the heat treatment condition No. T4, and at 160° C.—the heat treatment condition No. T6. Results of tensile mechanical properties of the pressed strips are shown in Table 3.

TABLE 3

Mechanical properties of pressed strips

| No[1] | Aging condition | σ, MPa | $\sigma_{0.2}$, MPa | δ, % |
|---|---|---|---|---|
| 8 | T4 | 348 | 229 | 19.2 |
| | T6 | 486 | 452 | 14.4 |

[1]Composition No. 3 (see Table 1)

Example 3

The inventive alloy of compositions 2, 4, 6, 8, 10 (Table 1) was used in a laboratory setting to produce flat ingots having a cross-section of 120×40 mm Next, the ingots were homogenized. The homogenized ingots were hot rolled into a sheet with the thickness of 5 mm at the initial temperature of 450° C. and then cold rolled into a sheet with the thickness of 1 mm. The rolled sheets were water hardened from the temperature of 450° C. The sheets were aged at the temperature of 160° C. (condition T6). Results of tensile mechanical properties of the sheets are shown in Table 4. The composition of the alloy No. 11 which is beyond the claimed range had poor working performance (at the stage of working the specimen was destroyed).

TABLE 4

Mechanical properties of sheets under the condition No. T6

| No[1] | $\sigma_{0.2}$, MPa | σ, MPa | δ, % |
|---|---|---|---|
| 2 | 410 | 360 | 14.5 |
| 4 | 489 | 531 | 7.4 |
| 6 | 471 | 511 | 8.5 |
| 8 | 462 | 498 | 8.1 |
| 10 | 508 | 544 | 7.1 |
| 11 | | Roll cracking | |

[1]Alloy composition (see Table 1)

Example 4

The duration of natural aging at a room temperature (condition No. T4) was selected based on the change of hardness (HB) using as an example the inventive alloy with the composition 4 (Table 1). Results of hardness measurement for hardened sheets are shown in Table 5. As can be seen from Table 5, the hardness growth started decelerating after 24 hours, and after 72 hours of holding, the gap between maximum values was no more than 3%.

TABLE 5

Hardness changing at the natural aging (condition No. T4)

| | Time after hardening, hours | | | | | |
|---|---|---|---|---|---|---|
| | 1 | 3 | 8 | 24 | 72 | 240 |
| HB | 86 | 90 | 108 | 125 | 135 | 139 |

Example 5

To defend the condition selected for homogenization and hardening in the claimed range of alloy concentrations, critical temperatures of solidus and solvus of the experimental compositions shown in Table 1 were calculated. Table 6 shows the calculation results.

TABLE 6

Solidus and solvus temperatures of the experimental alloys

| No[1] | $T_{sol}$, ° C. | $T_{ss}$, ° C. |
|---|---|---|
| 2 | 610 | 328 |
| 3 | 587 | 386 |
| 4 | 595 | 379 |
| 5 | 580 | 403 |
| 6 | 590 | 392 |
| 7 | 579 | 401 |
| 8 | 588 | 394 |
| 9 | 575 | 412 |
| 10 | 568 | 422 |
| 11 | 537 | 455 |

[1]See Table,
$T_{sol}$—solidus temperature;
$T_{ss}$—solvus temperature

As can be seen from Table 6, the greatest possible heating temperature obtained at the stage of ingot homogenization for the claimed range of doping element concentrations is in the range of 568 to 610° C., respectively. Water hardening to obtain a supersaturated hard aluminum solution of experimental alloys can be conducted at a heating temperature above 328° C. and 422° C., depending on the range of doping element concentrations. Articles produced from the composition No. 9 at a heating temperature above 537° C. will be melted which is nonrecoverable.

Example 6

The effects of cooling rate on mechanical properties were assessed based on values of mechanical properties (σ—the tensile strength, MPa, $\sigma_{0.2}$—the yield point, MPa, δ—the specific elongation, %) using turned cylindrical specimens having a length which is 5 times the diameter and cut out from a "bar" casting according to the GOST 1593. For this, specimens were cast in a dead mold and a metal mold. Mechanical properties were compared under the condition No. T6 which provided the best mechanical properties (Table 7).

TABLE 7

| No[1] | Mold material | d, μm | σ, MPa | $\sigma_{0.2}$, MPa | δ, % |
|---|---|---|---|---|---|
| 6 | Metal mold | 1.8 | 496 | 441 | 6.4 |
| | Dead mold | 4.5 | 297 | — | <0.1 |

[1]Alloy composition (see Table 1)

Figure 1B:
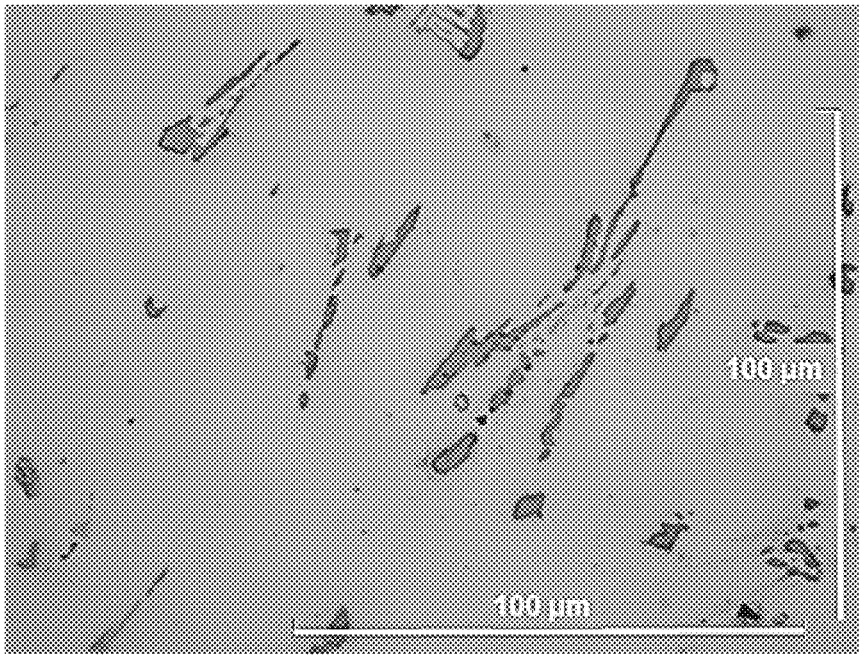
FIG. 1*b* shows a typical structure for dead-mold casting, where a coarse eutectic component is present which deteriorates mechanical properties.
Figure 2:
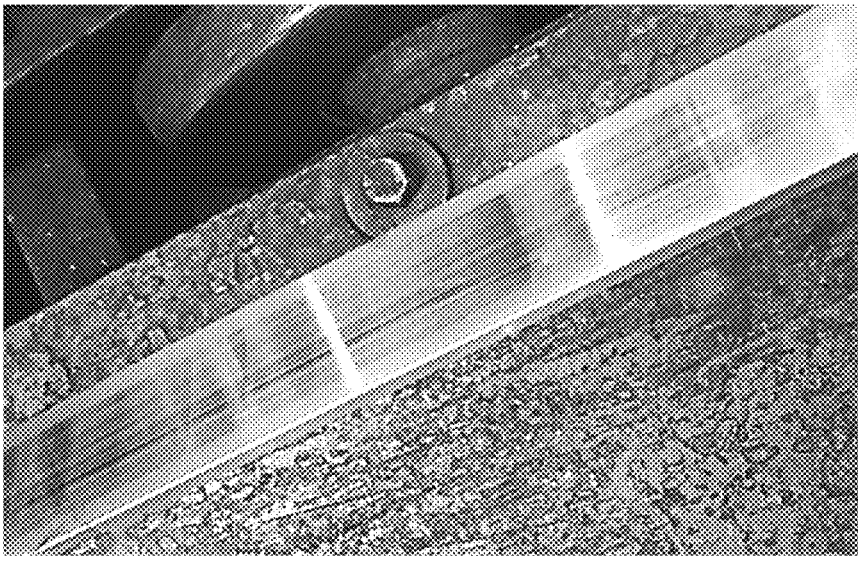
FIG. 2 shows a strip with a cross-section of 6×55 mm made of the alloy produced by working homogenized ingots at the initial ingot temperature of 400° C.

As can be seen from the comparison results, the formation of the desired structure with the average size of a eutectic component of 1.8 μm caused the difference between mechanical properties. In addition, this structure shown in FIG. 1*a* is typical for metal mold casting conducted by the following processes: the low-pressure casting, the gravity casting, piezocrystallization casting. A dead-mold cast structure (FIG. 1*b*) will have a coarse eutectic component adversely affecting mechanical properties.

Example 7

Figure 3:
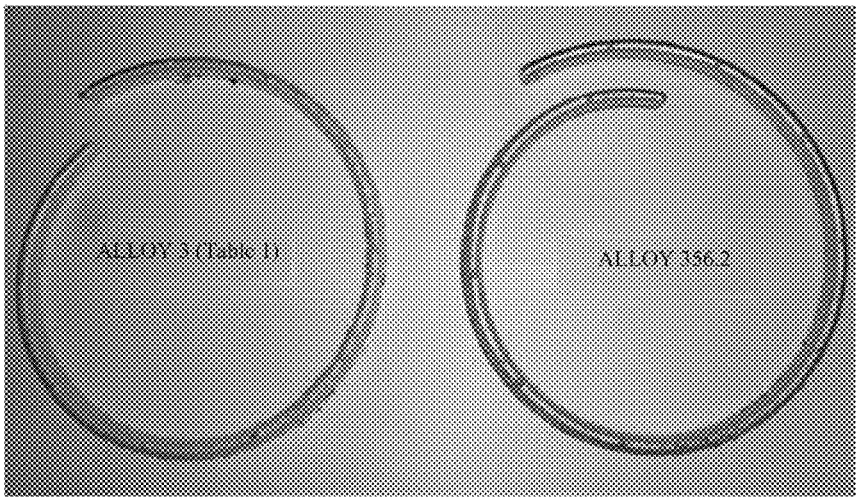
FIG. 3 shows castings of spiral specimens made of the claimed alloy of the composition #6 (Table 1) and A356.2 evidencing that the first composition has a high flowability corresponding to the A356.2 alloy (Table 8).

The performance of cast mold filling was assessed for flowability on a "spiral" specimen. Spiral castings shown in FIG. 3 made of the claimed alloy of the composition 6 (Table 1) and A356.2 represent that the first composition is highly flowable and corresponds to the alloy A356.2 (Table 8).

TABLE 8

| No | Bar length, mm |
|---|---|
| 6[1] | 525 |
| A356.2 | 585 |

[1]Alloy composition (see Table 1)

Example 8

The performance of the claimed alloy for welded joints produced by argon-arc welding was assessed using compositions 14 and 15 (Table 9). To do this, sheets were produced using the process of Example 3 and then welded and heat treated under the condition No. T6. Results of weld joint experiments.

TABLE 9

Compositions of experimental alloys

| | Concentration in the alloy, wt. % | | | | | | | | | |
|---|---|---|---|---|---|---|---|---|---|---|
| No | Zn | Mg | Ni | Fe | Cu | Zr | Sc | Ti | Cr | Al |
| 14 | 5.7 | 1.9 | 1.5 | 0.8 | 0.15 | 0.11 | <0.001 | 0.05 | 0.08 | Rest |
| 15 | 6.5 | 2.4 | 0.6 | 0.3 | 0.25 | 0.14 | <0.001 | 0.01 | 0.15 | Rest |

TABLE 10

Mechanical properties of sheets under the condition No. T6

| No[1] | | $\sigma_{0.2}$, MPa | σ, MPa | δ, % |
|---|---|---|---|---|
| 14 | Weldless | 482 | 501 | 12.1 |
| | Weld joint | 471 | 492 | 8.5 |
| 15 | Weldless | 468 | 492 | 8.1 |
| | Weld joint | 461 | 481 | 5.1 |

[1]Alloy composition (see Table 9)

Example 9

Alloys of compositions 16 and 17 were used to produce "bar" castings according to GOST 1593. Castings were tested after hardening from the temperature of 540° C. and natural aging at a room temperature for 72 hours.

TABLE 11

Compositions of experimental alloys

| | Concentration in the alloy, wt. % | | | | | | | | | |
|---|---|---|---|---|---|---|---|---|---|---|
| No | Zn | Mg | Ni | Fe | Cu | Zr | Sc | Ti | Cr | Al |
| 16 | 5.5 | 2.1 | 1.5 | 0.3 | 0.15 | 0.15 | 0.08 | 0.02 | <0.001 | Rest |
| 17 | 6.2 | 2.4 | 0.6 | 0.5 | 0.25 | 0.11 | 0.1 | 0.04 | <0.001 | Rest |

TABLE 12

Mechanical properties of castings under the condition No. T4

| No | $\sigma_{0.2}$, MPa | σ, MPa | δ, % |
|---|---|---|---|
| 16 | 231 | 392 | 15.2 |
| 17 | 243 | 415 | 12.3 |

[1] Alloy composition (see Table 11)

Example 10

A temperature of aging conducted following the hardening operation was selected based on the change of hardness (HB) using as an example the inventive alloy with the composition 4 (Table 1). Results of hardness measurement for hardened sheets are shown in Table 13. As can be seen from Table 13, the significant strengthening gain is observed up to 160° C. Aging at 180° C. reduces hardness because of overaging processes.

TABLE 13

Hardness changing in the temperature range

| | Aging temperature, ° C. | | | |
|---|---|---|---|---|
| | 120 | 140 | 160 | 180 |
| HB | 170 | 173 | 181 | 155 |

The invention claimed is:

1. A high-strength aluminum-based alloy consisting of aluminum, zinc, magnesium, nickel, iron, copper, zirconium, and one or more metal or metals selected from a group consisting of titanium, scandium, and chromium with the following ratios, expressed in terms of wt. %:

| | |
|---|---|
| Zinc | 3.8-4.5 |
| Magnesium | 1.2-1.5 |
| Nickel | 0.5-0.7 |
| Iron | 0.3-0.45 |
| Copper | 0.01-0.25 |
| Zirconium | 0.11-0.2 |
| Titanium | up to 0.02 |
| Scandium | up to 0.10 |
| Chromium | up to 0.10 |
| Aluminum | the rest, |

wherein iron and nickel create aluminides of an $Al_9FeNi$ eutectic phase wherein the volume fraction is in the range 2.0-2.4 vol. %, wherein iron and nickel create eutectic aluminides having a particle size no more than 2 μm, wherein the Ni/Fe ratio of the alloy is ≥1, wherein zirconium and titanium are substantially in the form of secondary phases having a particle size of no more than 20 nm and having a $L1_2$ crystal lattice.

2. The alloy of claim 1, wherein aluminum is produced by electrolysis using an inert anode.

3. A method for producing a wrought article made of a high-strength alloy, the method comprising:

preparing a melt, producing ingots by melt crystallization, homogenizing annealing of the ingots to produce homogenized ingots, producing wrought articles by working the homogenized ingots, heating the wrought articles, holding the wrought articles for hardening at a predetermined temperature and water hardening of the wrought articles, aging the wrought articles, wherein the alloy is in accordance with claim 1, wherein the ingots are homogenized by annealing at a temperature of no more than 560° C., wherein the wrought article is held for hardening at a temperature in the range of 380-450° C., and wherein the wrought article is aged a temperature of no more than 170° C.

4. The method in accordance with claim 3, wherein the wrought article is aged at least in two steps: at a first step at a temperature of 90-130° C., and at a second step at a temperature up to 170° C.

5. The method in accordance with claim 3, wherein the wrought article is aged with holding at a room temperature for at least 72 hours.

6. A method for producing castings from a high-strength alloy, the method comprising:

preparing a melt, producing a casting, heating the casting, holding the casting for hardening at a predetermined temperature, water hardening the casting and aging the casting, wherein the alloy is in accordance with claim 1, wherein the casting is held for hardening at a temperature of 380-560° C., and the casting is aged at a temperature of no more than 170° C.

7. The method in accordance with claim 3, wherein the casting is aged at least in two steps: at a first step at a temperature of 90-130° C., and at a second step at a temperature up to 170° C.

8. The method in accordance with claim 3, wherein the casting is aged with holding at a room temperature for at least 72 hours.

* * * * *